US006162057A

United States Patent [19]

Westphal et al.

[11] Patent Number: 6,162,057

[45] Date of Patent: Dec. 19, 2000

[54] MOBILE SHOOTING RANGE

[75] Inventors: Robert L. Westphal, Fountain Valley, Calif.; Tommy L. Forbes, Reno, Nev.

[73] Assignee: Shooting Solutions, Inc., Fountain Valley, Calif.

[21] Appl. No.: 09/286,918

[22] Filed: Apr. 6, 1999

Related U.S. Application Data

[60] Provisional application No. 60/080,766, Apr. 6, 1998.

[51] Int. Cl.[7] ..... F41A 33/00

[52] U.S. Cl. ..... 434/11; 434/16

[58] Field of Search ..... 434/11, 16, 19, 434/20, 23, 12; 273/357, 359, 395; 280/838, 839, 204, 727, 762, 656, 789; 296/168, 181

[56] References Cited

U.S. PATENT DOCUMENTS

| | | | |
|---|---|---|---|
| Re. 30,013 | 5/1979 | Knight | 273/105.2 |
| 3,800,966 | 4/1974 | Newton | 414/550 |
| 3,802,705 | 4/1974 | Burns | 273/101 |
| 4,509,301 | 4/1985 | Head | 52/79.8 |
| 5,031,920 | 7/1991 | Poirier | 273/371 |
| 5,088,741 | 2/1992 | Simonetti | 273/410 |
| 5,257,936 | 11/1993 | Ambrosi | 434/11 |
| 5,564,712 | 10/1996 | Werner | 273/410 |
| 5,577,733 | 11/1996 | Downing | 273/348 |
| 5,848,791 | 12/1998 | Beyer | 273/359 |

FOREIGN PATENT DOCUMENTS

| | | | |
|---|---|---|---|
| 2504669 | 10/1982 | France | 434/11 |

*Primary Examiner*—Jacob K. Ackun
*Assistant Examiner*—Kurt Fernstrom
*Attorney, Agent, or Firm*—James G. O'Neill

[57] ABSTRACT

A lightweight, movable shooting range for use with frangible ammunition. Much lighter weight, hardened alloy ceilings, floors and side walls may be used over the majority of the internal shooting area, thereby substantially lightening the total weight of the trailer. The mobile shooting range includes a shooting impact area at one end with sufficient armor plate to absorb any frangible ammunition being fired into an absorbing material mounted in the front of the impact area. At the other or forward end of the trailer, a control booth contains electronic controls and equipment to allow a range operator to monitor the shooting performance of any person shooting from shooting stalls mounted within the trailer. Appropriate fans and filters are provided to prevent any smoke, or the like, from collecting within the trailer, and air conditioning or other climate control means may be provided to control the interior temperature thereof. In addition, the flooring of the trailer is preferably provided with rubber-type matting for comfort and sound absorbing qualities.

8 Claims, 5 Drawing Sheets

MOBILE SHOOTING RANGE

CROSS-REFERENCE TO RELATED APPLICATION

This application is a continuation of provisional application No. 60/080,766, filed Apr. 6, 1998.

BACKGROUND OF THE INVENTION

1. Field of the Invention

This invention relates generally to shooting ranges, and, more particularly, to a lightweight mobile shooting range for use with frangible ammunition.

2. Description of Related Art

Military personnel and peace officers have to qualify in shooting ranges to meet the requirements of their professions. Mobile shooting ranges pulled by large, powerful tractors are known for such use. Such mobile shooting ranges are equipped with heavy armor plating around all of the shooting area, so as to enable lead ammunition to be fired safely therein. However, because of the use of the required heavy armor plating, known mobile shooting ranges are expensive to manufacture, and are heavy and difficult to transport. Furthermore, such known mobile shooting ranges cannot be used in areas, which do not have a surface of sufficient rigidity to support the heavy weight thereof. In addition, environmental concerns are raised by the use of lead ammunition, together with any fumes emitted by the shattering of such lead ammunition against targets, both within mobile shooting ranges, and when exhausted to the atmosphere from such mobile shooting ranges.

SUMMARY OF THE INVENTION

Accordingly, it is a general object of the present invention to provide an improved mobile shooting range. It is a particular object of the present invention to provide an improved lightweight mobile shooting range. It is another particular object of the present invention to provide an improved mobile shooting range for use with frangible ammunition. It is yet a more particular object of the present invention to provide an improved mobile shooting range having armor plate only in selected portions of the impact area thereof. It is still a further particular object of the present invention to provide an improved mobile shooting range for use with frangible ammunition having limited armor plating, with the majority of the internal shooting area protected by a hardened alloy material.

In accordance with one aspect of the present invention, there is provided a mobile shooting range comprised of an elongated fifth wheel trailer, that is light enough that it may be pulled by a pick-up truck. The mobile shooting area has an armor plated, frangible ammunition impact area at one end thereof, and non-armor plated metallic material sides, tops and bottoms over the remainder of the shooting area inside the trailer. This non-armor plated metallic material is strong enough to stop the impact of frangible ammunition. The mobile shooting range of the present invention is also provided with blowers to evacuate air contaminated by gun smoke, and a control booth having electronic controls and associated elements, for measuring the performance of a shooter.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved, lightweight, mobile shooting range 10, for use with frangible ammunition, capable of being pulled by a one-ton pick-up truck.

Figure 1:
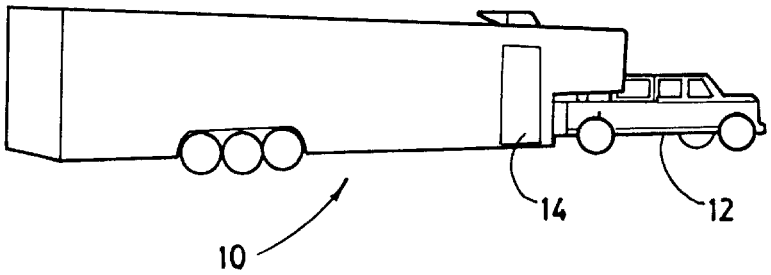
FIG. 1 is a side elevational view of a preferred embodiment of the mobile shooting range of the present invention being pulled by a pick-up truck.
Figure 2:
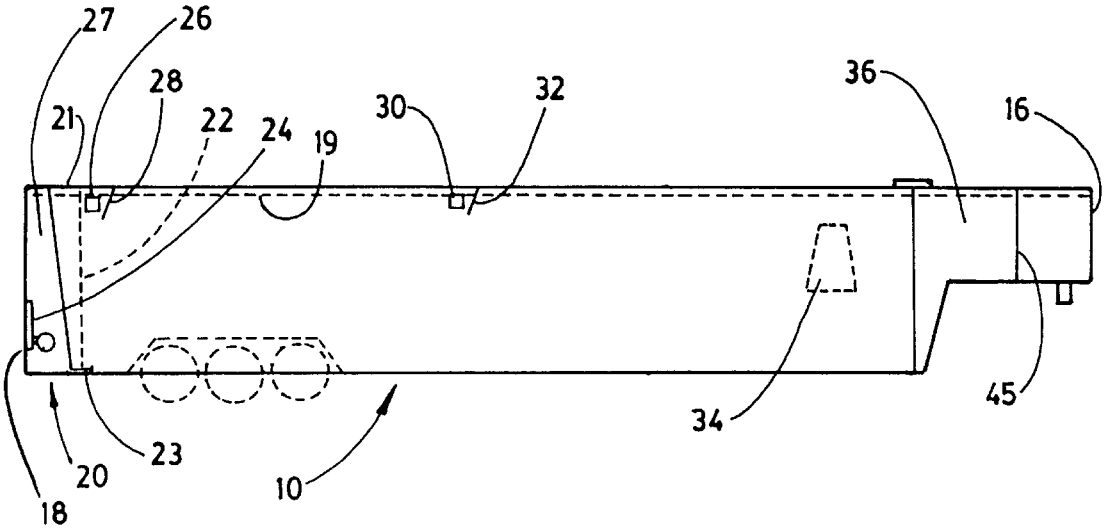
FIG. 2 is a side elevational view, partly in cross-section, of the mobile shooting range of FIG. 1, without the pick-up truck.

The mobile shooting range 10 of the present invention may be of any desired size, but is preferably a 48 foot long, fifth wheel or gooseneck-type trailer, having a complete three-position, 10 meter shooting range held therein. As best shown in FIGS. 1 and 2, the trailer 10 includes a plurality of wheel and a first door 14 positioned near a narrowed front end portion 16, to allow entry into and exit from the interior of the trailer. The exterior of the trailer may be provided with any desired finish, such as that currently provided on most trailers. However, the interior walls of at least the shooting area, are partly protected by armor plating, but mostly by a hardened alloy material 19, that can withstand a point blank impact of any frangible ammunition, such as that available from Winchester, used therein. Because the hardened alloy material 19, such as 60–61 aluminum, 3/16 inches thick, used to protect the majority of the interior walls in the shooting area is approximately ⅓ the weight of armor plate, the mobile shooting range 10 of the present invention is light enough to be easily towed by the one-ton pick-up truck 12.

Figure 5:
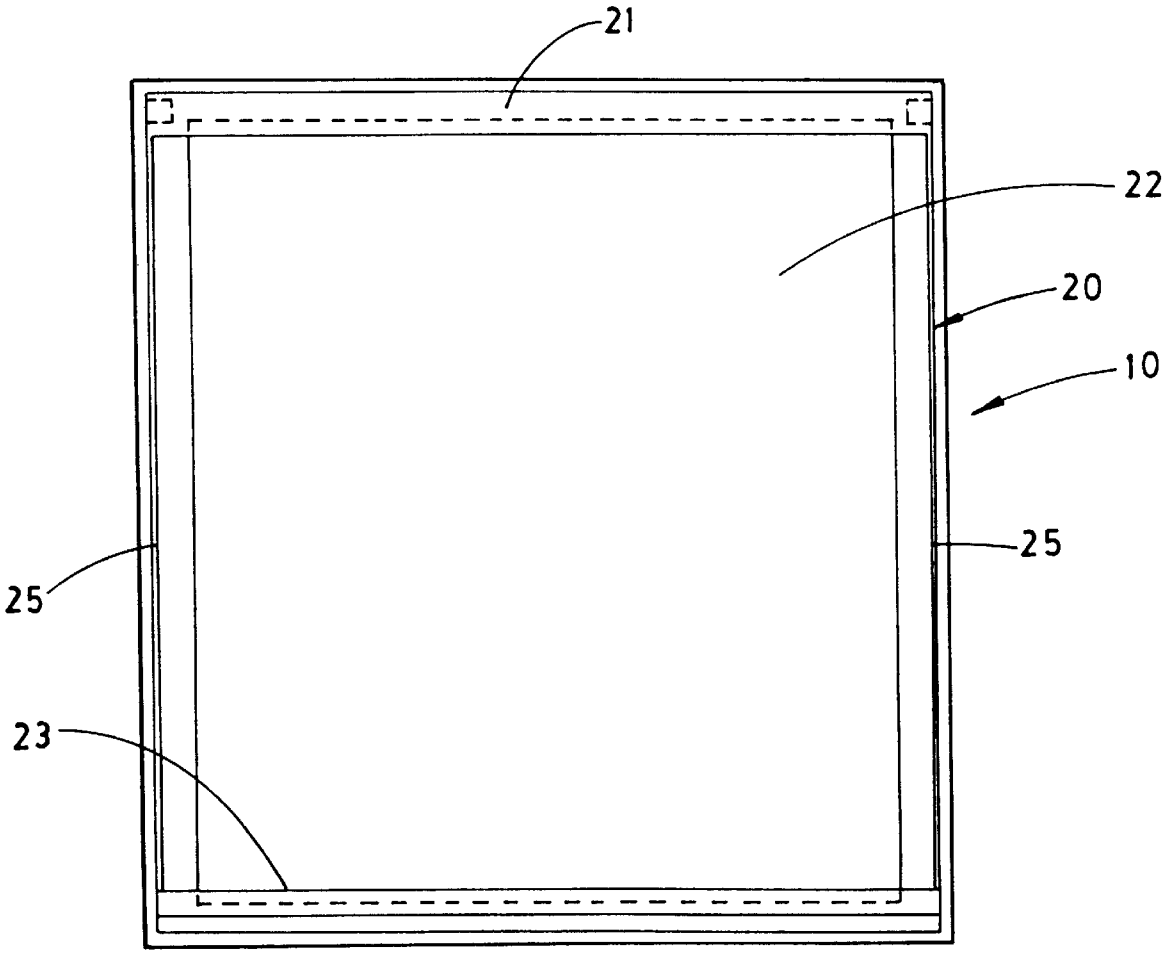
FIG. 5 is a cross-sectional view of the trailer, looking toward the shooting impact area.
Figure 6:
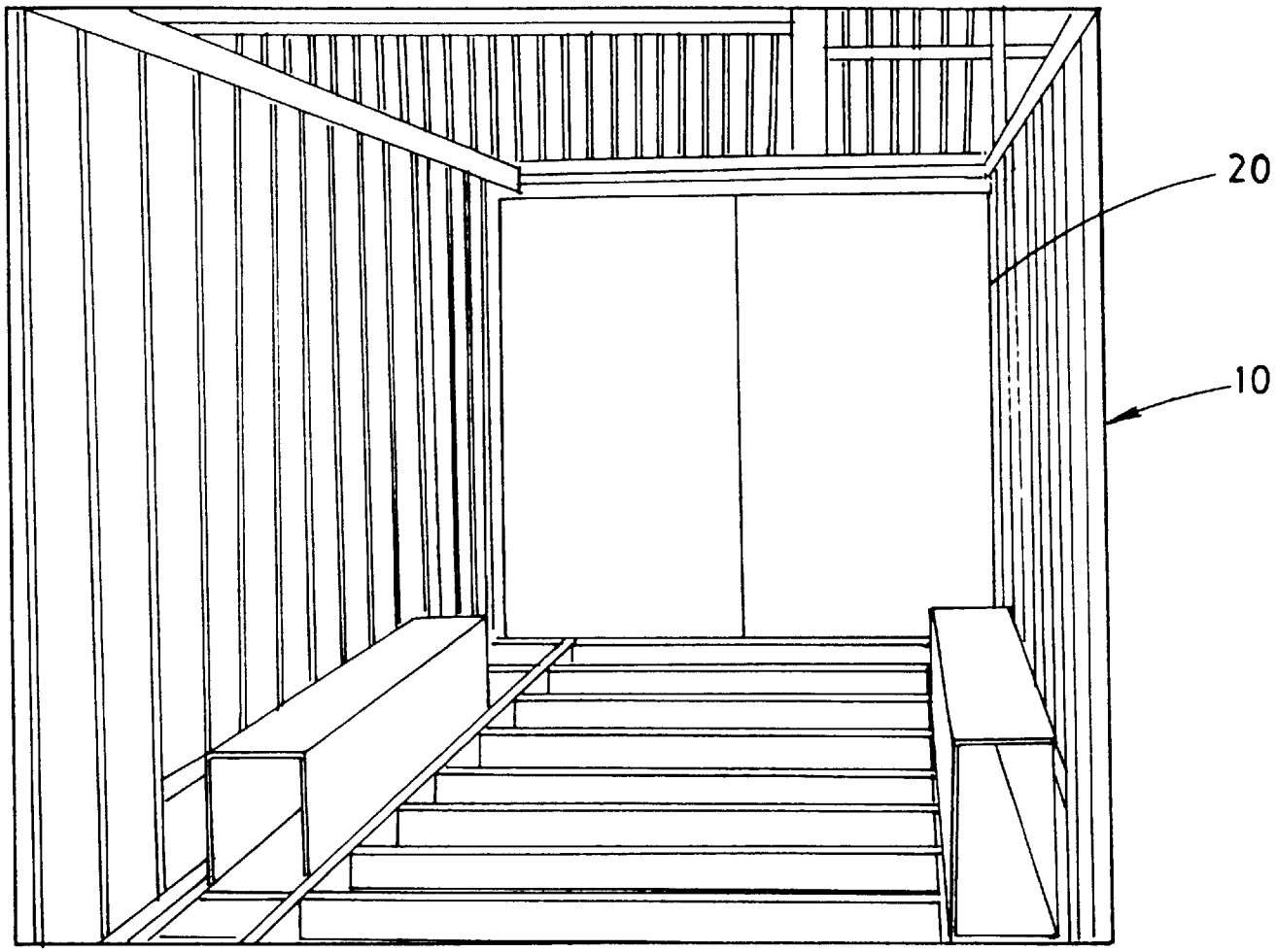
FIG. 6 is a partial, cross-sectional view of the trailer, looking toward the shooting impact area, with the insulation and protective exterior and interior siding removed to show the wall stud and wheel wells of the trailer.

Immediately in front of an armored rear end or wall 18 of the trailer is a shooting impact area or wall 20, also made from armor plate. As shown in FIGS. 1 and 5, the armor plate of this impact area 20 covers or extends over the entire rear end or wall 18, a portion of the ceiling 21, a portion of the floor 23 and side wall portions 25, out to a maximum distance of approximately four feet from the impact area 20, toward a firing line. The remainder of the floor includes the hardened alloy material, and may include insulation and a rubber matting to protect the same, and prevent slipping. A frangible ammunition absorbing material 22, such as Linotex, or the like, is provided as lining in front of the impact area 20. A space 27 is preferably provided between the rear of the impact area 20 and the interior of rear wall 18, and includes a blower 24 mounted on the rear, armored end wall 18, or on the roof, with the rear compartment being used as storage. The rear end wall 1 8 may also be provided with an access door and a vent for the blower 24, may be provided in end wall 18 or the roof.

The interior of the trailer, in addition to the hardened alloy inner walls 19, adjacent to, but in front of the impact area 20, is provided with one or more sensors 26 behind a protective armor plate shield 28. Additionally, at least one projector 30 for showing various shooting situations, is also held behind an armor plate shield 32, and mounted toward the front 16 of the trailer, between the impact area 20 and a shooting stall position 34. The projector 30 may be enclosed in a metal container that includes a suction fan and filter. The shooting stall position 34 preferably has three shooting positions, is fabricated out of metal, and is provided with hinges, or other equivalent means, so that it can be folded flat against a wall of the trailer, and held in this position during transportation, or when not in use.

Figure 3:
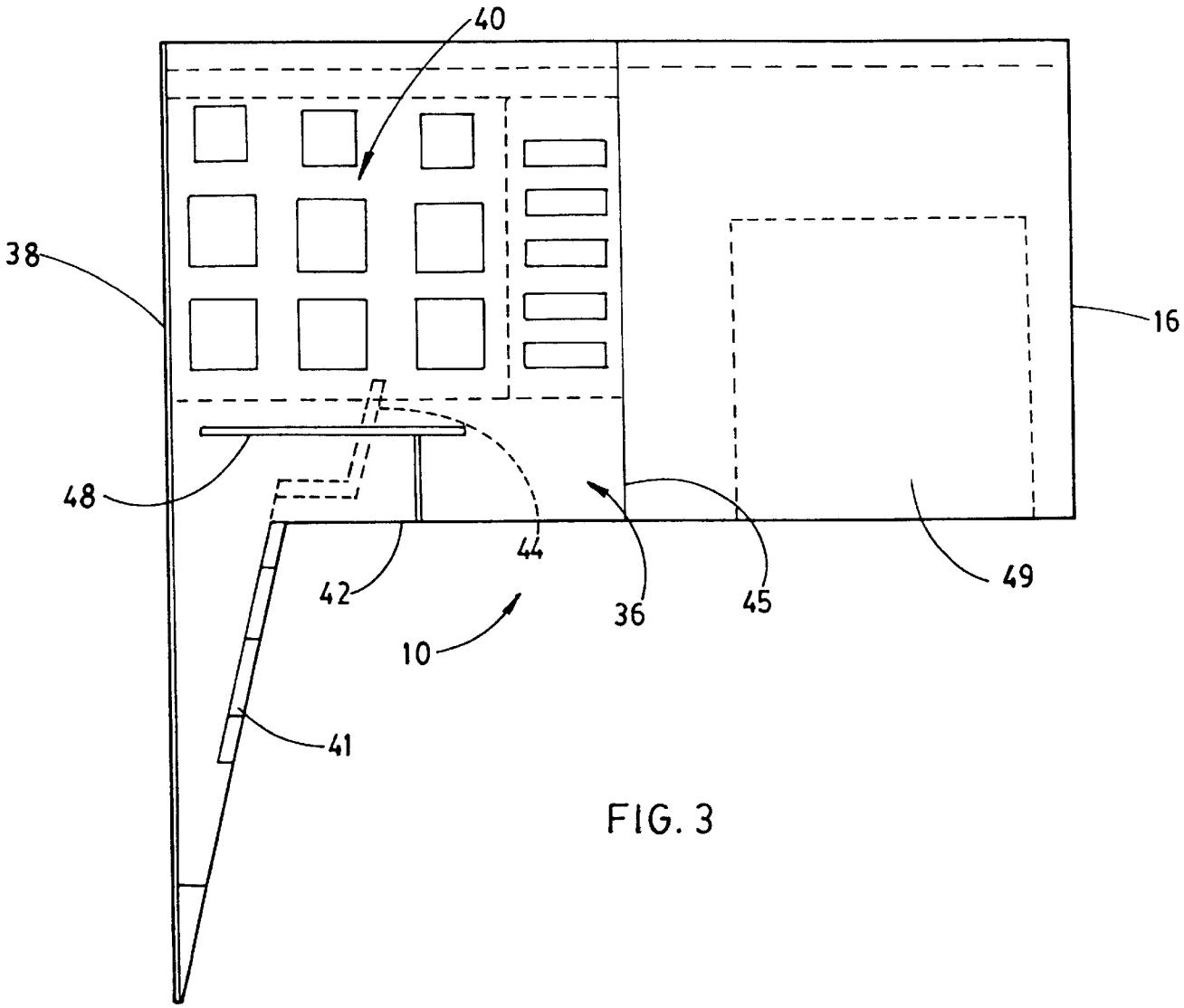
FIG. 3 is an enlarged, partial cross-sectional view through the narrow front section, at the right hand side of the trailer shown in FIG. 2.
Figure 4:
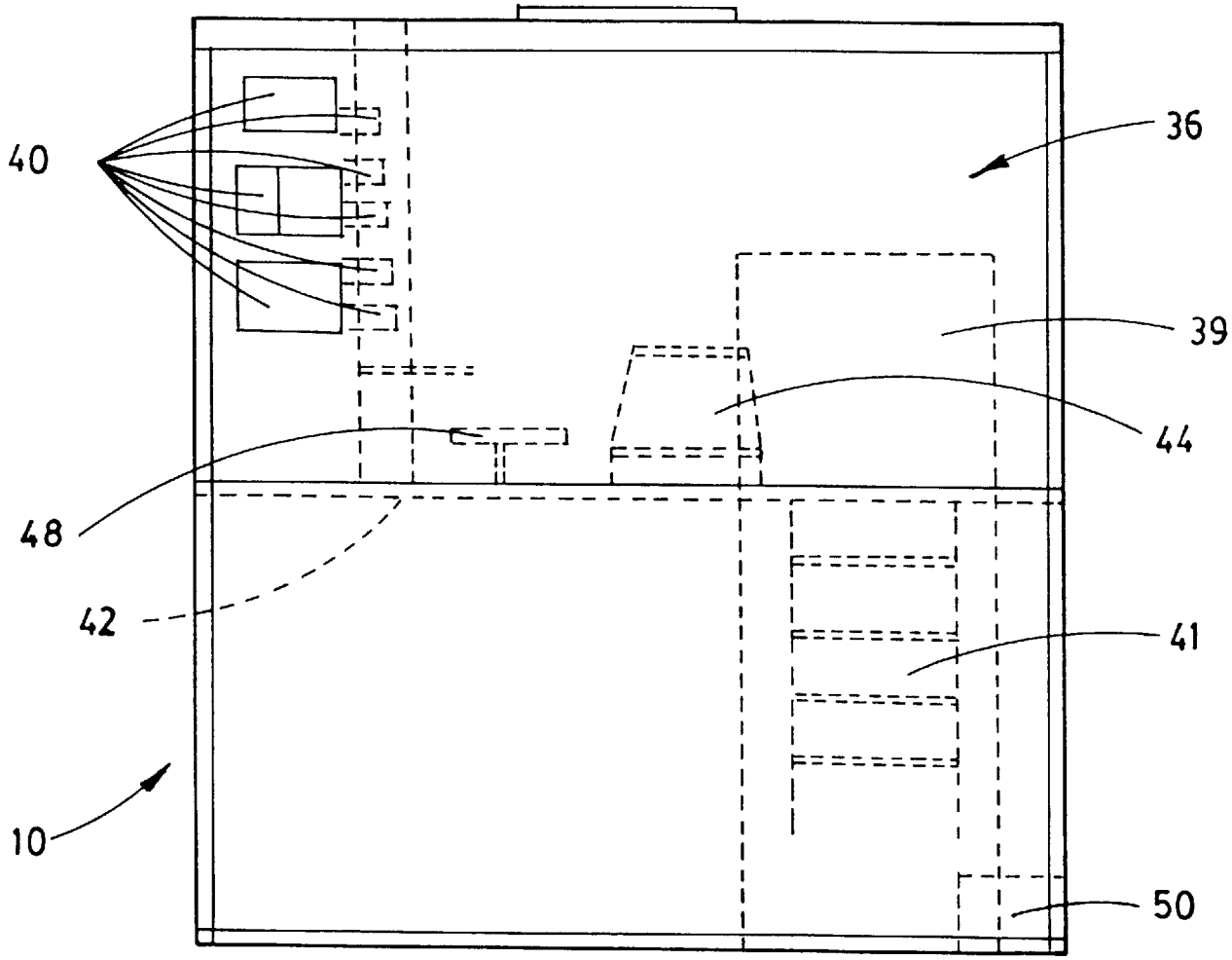
FIG. 4 is an enlarged, cross-sectional view through the trailer of FIG. 1, looking toward the control housing.

As best shown in FIGS. 1–3, a control booth 36 is provided in the trailer, toward front end 16, after the shooting stall position 34. A ballistic glass and bullet-proof panel arrangement or wall 38 having a door 39 (see FIG. 4), therein preferably protects this control booth. The control booth houses a flight of steps 41 up to a platform 42 holding a series of electrical equipment 40, such a computers and monitors. The booth may be provided with cabinets or other means, to support the electrical equipment and/or computers and monitors. Additionally, there is preferably a chair 44 and a desk 48 that may be folded out of the way, for the use of a range operator. At the rear of the control booth, toward the front 16 of the trailer, a partition 45 is provided having a further door (not shown), behind which are held a portable power supply, such as a generator 49, and a circuit breaker panel. There is also space for storage, or the like. The generator is preferably approximately seven kilowatts, and used to operate a fifty-amp service. This 50-amp service can also be operated by a 110 or 220 volt power source. A series of 12 volt batteries 50 may be mounted in the booth to operate a system (not shown) to raise and lower the front of the trailer in the pickup bed, and/or to provide emergency or backup lighting and/or air conditioning systems.

The space between interior and exterior walls, the floor, the ceiling or top and the side walls of the trailer, preferably have at least two inches of insulation for sound reduction, as well as for control of the temperature within the trailer. An additional three inches of insulation is provided on the interior walls, over the hardened allow material, further reducing sound.

It, therefore, can be seen that the present invention provides a novel, lightweight, mobile shooting range having hardened alloy walls, for use with frangible ammunition to thereby provide a relatively light and inexpensive mobile shooting range that also overcomes problems caused by using lead ammunition. It is obvious that the interior ceiling, floor and side walls of the shooting area within the trailer, made from a hardened alloy material, away from the shooting impact area at the rear end thereof, is much lighter than the armor plating used throughout known mobile shooting ranges. Therefore, the mobile shooting range of the present invention is used only with frangible ammunition and is light enough to be pulled by a one-ton pick-up truck when the fifth wheel hitch portion thereof is secured to a hitch mounted within the bed of the pick-up truck.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A mobile shooting range, comprising, in combination:

a one-ton pick-up truck having a bed;

a lightweight, elongated body mounted on a plurality of wheels; the lightweight, elongated body having a first end, a narrow second end, an external housing, a plurality of internal side walls, a ceiling and a floor;

an armor plate shooting impact area at the first end;

a control booth, having a ballistic glass and bullet-proof wall, with a door therein, adjacent the second narrow end;

a shooting stall position in the lightweight, elongated body, between the ballistic glass and bullet-proof wall and the armor plate shooting impact area;

a hardened, lightweight aluminum alloy material about 3/16" thick capable of stopping frangible ammunition, lining the plurality of internal side walls, the ceiling and the floor between the control booth and the armor plate shooting impact area;

the armor plate shooting impact area only being covered by a frangible ammunition absorbing material; and the lightweight, elongated body having the second narrow end sized and shaped so as to be supported and held in the bed of the one-ton pick-up truck, to enable the mobile shooting range to be towed by the one-ton pick-up truck.

2. The mobile shooting range of claim 1, further including a space formed behind a rear surface of the armor plate shooting impact area and the first end, and a blower provided with a vent, to exhaust the space.

3. The mobile shooting range of claim 2 wherein the shooting stall has three shooting positions.

4. The mobile shooting range of claim 3, further including at least one sensor mounted in the lightweight, elongated housing, in front of the frangible ammunition absorbing material, toward the shooting stall.

5. The mobile shooting range of claim 4, further including at least one projector, mounted in the lightweight, elongated housing, between the at least one sensor, and the shooting stall.

6. The mobile shooting range of claim 5 wherein the control booth includes a desk and a chair for a range operator.

7. The mobile shooting range of claim 6, further including a portable power supply and space for storage in the second end.

8. The mobile shooting range of claim 1, further including a door in one side of the lightweight, elongated body.

* * * * *